US005267872A

United States Patent [19]

Gou et al.

[11] Patent Number: 5,267,872

[45] Date of Patent: Dec. 7, 1993

[54] CARD-EDGE CONNECTOR APPARATUS AND METHOD OF MOLDING THE SAME

[75] Inventors: Taiming Gou; Sidney Lu, both of Taipei, Taiwan

[73] Assignee: Foxconn International, Inc., Sunnyvale, Calif.

[21] Appl. No.: 887,093

[22] Filed: May 22, 1992

[51] Int. Cl.[5] ..... H01R 13/62

[52] U.S. Cl. ..... 439/326; 439/328; 439/341

[58] Field of Search ..... 439/326, 327, 328, 629, 439/633, 64, 350; 285/319; 403/321, 319; 292/19

[56] References Cited

U.S. PATENT DOCUMENTS

| | | | |
|---|---|---|---|
| 4,713,013 | 12/1987 | Regnier et al. | 439/62 |
| 4,737,120 | 4/1988 | Grabbe et al. | 439/326 |
| 4,850,891 | 7/1989 | Walkup et al. | 439/326 |
| 4,850,892 | 7/1989 | Clayton et al. | 439/326 |
| 4,929,194 | 5/1990 | Korsunsky et al. | 439/328 |
| 4,986,765 | 1/1991 | Korsunsky et al. | 439/326 |
| 4,995,825 | 2/1991 | Korsunsky et al. | 439/328 |
| 5,002,498 | 3/1991 | Takahashi | 439/326 |
| 5,004,429 | 4/1991 | Yagi et al. | 439/326 |

FOREIGN PATENT DOCUMENTS

| | | | |
|---|---|---|---|
| WO90/04272 | 4/1990 | PCT Int'l Appl. | 439/328 |

*Primary Examiner*—Daniel W. Howell
*Assistant Examiner*—Hien D. Vu
*Attorney, Agent, or Firm*—Flehr, Hohbach, Test, Albritton & Herbert

[57] ABSTRACT

A card-edge connector assembly (30) for releasably securing a circuit board (13) having an elongated insulative housing (32) formed of a moldable material and defining an elongated channel (40) in a surface (38) of the housing (32). Integrally formed latches (36, 36'), disposed on opposite ends of the elongated channel, include latch lever portions (44, 44') extending upwardly and rearwardly therefrom to facilitate access to the latches (36, 36'). Backstops (42, 42') are integrally formed with the housing and extend outwardly from the housing surface to positions vertically below the latch levers, respectively. A slot (64, 64') is formed between the backstop and the latch members. Each latch lever defines a central mold opening (46, 46') extending therethrough and positioned in vertical alignment with the corresponding backstops. Each mold opening is sufficiently large to permit withdrawal of a slot defining-mold component (74) along a linear path away from the slots therethrough during integral molding of the connector assembly. The mold opening is further sufficiently small to provide substantial area on the latch lever portion to enable manual release of the latch members.

8 Claims, 2 Drawing Sheets

CARD-EDGE CONNECTOR APPARATUS AND METHOD OF MOLDING THE SAME

TECHNICAL FIELD

The present invention relates, generally, to card-edge connectors and, more particularly, to moldable latch socket connectors and methods of manufacturing the same.

BACKGROUND ART

In recent years, a substantially effort has been directed towards card-edge connector design in an attempt to make them more durable, as well as simplify manufacture and production. In particular, Single In-line Packages (SIP), Memory Module, Single In-line Memory Modules (SIMM) and Circuit Module connectors have enjoyed considerable design evolution. Typically, as shown in FIGS. 1 and 2, these connectors 10 include an elongated insulative housing 11 having a channel 12 formed to receive a front edge of an SIMM 13. Positioned on opposing ends of channel 12 are resilient latch members 14 and 14' including detent members 15 and 15' formed and dimensioned to releasably engage the side edges 16 and 16' of SIMM 13, once in the operation position.

Initially, latch members 14 and 14' were integrally formed with housing 10 through injection molding. As shown in FIG. 1, each latch member 14 and 14' includes a resilient body portion 17 and 17' formed to be urged respectively rearward in a direction away from channel 12 so that detent member 15 and 15' would clear side edge 16 and 16' in order to release card 13. Body portions 17 and 17', however, would often break or crack through fatigue or over exertion of release forces applied to latches 14 and 14'. Typical patented prior art unitary card-edge connectors including integrally formed latches may be found in U.S. Pat. Nos. 4,850,892 to Clayton et al.; 4,737,120 to Grabbe et al. and 4,713,013 to Regnier et al.

This problem has been reduced by incorporating any one of two changes. First, manufacturers began replacing integrally formed latches 14 and 14' with removable metal latches (not shown). These proved far more durable than their integral counterparts. While this alternative is very satisfactory in many instances, from a manufacturing viewpoint, it is much more burdensome and costly to produce than the unitary injection molded connector with integrally formed latches. The individual metal latches must be formed and dimensioned to be inserted into corresponding receiving sockets. Thus, manufacturers must carefully control the dimensions and tolerances between the mating parts because improper clearances may jeopardize the securement of the metal latch in the corresponding socket. Moreover, overall costs are substantially increased. Typical of such card-edge connectors employing metal latches are U.S. Pat. Nos. 5,004,429 to Yagi et al.; 4,995,825 to Korsunsky et al. and 4,986,765 to Korsunsky et al.

The second method employed to reduce the problem of latch fatigue and breakage corresponding to card-edge connectors having integrally molded latches is to provide a backstop member 18, as shown in FIG. 2, just rearward of latch 14. Backstop 18 limits the rearward deflection of latch member 14 so that latch member 14 may only be urged rearward by a distance sufficient to disengage detent 15 from side edge 16 of SIMM 13. One such card edge connector including a backstop may be found in U.S. Pat. No. 4,850,891 to Walkup et al.

Unfortunately, in this configuration, manual release is difficult because access to latch 14 is limited. To overcome this problem, cantilever portion 19, as shown in FIG. 2, have been added which extends rearwardly and upwardly from the distal end of body portion 17 of latch member 14. These additions promote increased access to latch members 14 and 14' so that manual release of SIMM 13 may be actuated.

Accordingly, for certain situations, this unitary card-edge connector integrally incorporating latch 14, backstop 18 and cantilever lever 19 is most desirable. Typical of this effort may be found in U.S. Pat. No. 5,002,498 to Takahashi.

The problem associated with these type card-edge connectors, however, is that they are much more complicated to manufacture by injection molding. As shown in FIG. 3, backstop 18 extends outwardly from latch member 14 forming a slot 20 therebetween. Slot 20 enables latch 14 to be urged rearwardly. Unfortunately, because cantilever portion 19 is inclined upwardly and outwardly from body portion 17, the top surface 21 of backstop 18 is positioned and terminates below portions of cantilever portion 19. This configuration precludes moldable formation of slot 20 and backstop top surface 21 using only a simple set of conventional vertically meshing mold components (not shown). Accordingly, an auxiliary slide core mold component (not shown), laterally inserted between backstop 18 and latch member 14 is necessary to moldably form slot 20 and backstop top surface 21.

Auxiliary slide core mold components, however, substantially complicate the manufacturing process. Precision dimensioning is required between the vertically meshing mold components and the corresponding slide core mold components which increases the cost of mold manufacture and maintenance of the molds. Further, the control of precision timing is necessary for proper manufacture. Moreover, these factors increase the overall cost of manufacture.

Accordingly, it is an object of the present invention to provide a unitary integrally molded card-edge connector assembly.

It is another object of the present invention to provide a card-edge connector assembly which simplifies manufacture of the same.

It is a further object of the present invention to provide a card-edge connector assembly which is durable, compact, easy to maintain, has a minimum number of components, and is economical to manufacture.

The apparatus of the present invention has other objects and features of advantage which will be more readily apparent from the following description of the Best Mode of Carrying Out the Invention and the appended claims, when taken in conjunction with the accompanying drawing.

DISCLOSURE OF INVENTION

A card-edge connector assembly of the present invention for releasably securing a circuit board having a front edge and opposite side edges. The card-edge connector comprises an elongated electrically insulative housing formed of a moldable material and defines an elongated channel in a surface of the housing. The elongated channel is formed and dimensioned to receive the front edge of the circuit board to operably couple the board in an operating position. A first latch member and a second latch member are positioned proximate opposite ends of the channel and are integrally formed with the housing. The first latch member and the second latch member each include a body portion extending outwardly from the surface of the housing, detent means extending outwardly from an upper end of the body portion for engaging the respective side edges of the circuit board, and a latch lever inclined angularly upwardly and outwardly from the upper end of the body portion. A first backstop member and a second backstop member are disposed proximate the first latch member and the second latch member, respectively. Each backstop member is integrally formed with the housing and each extends outwardly from the surface of the housing to positions below the latch lever. Further, each backstop member extends outwardly of the first latch member and the second latch member, respectively. The first backstop member and the second backstop member define with the first latch member and the second latch member slots which permit limited deflection of the first latch member and the second latch member toward the first stop member and the second stop member. The latch lever of each of the first latch member and the second latch member define a mold opening positioned in vertical alignment with the corresponding first stop member and the second stop member. The mold opening is sufficiently large to permit withdrawal of a latch member slot defining-mold component therethrough during integral molding of the latch members and the backstop members with the housing. The mold opening is further sufficiently small to provide substantial surface area on the latch lever portion to enable manual release of the latch members.

Accordingly, the present invention provides a unitary card-edge connector capable of being manufactured from meshing mold components without the additional usage of auxiliary slide core mold components.

BRIEF DESCRIPTION OF THE DRAWING

The purpose and advantages of the present invention will be apparent to those skilled in the art from the following detailed description in conjunction with the appended drawings in which.

BEST MODE OF CARRYING OUT THE INVENTION

Figure 1:
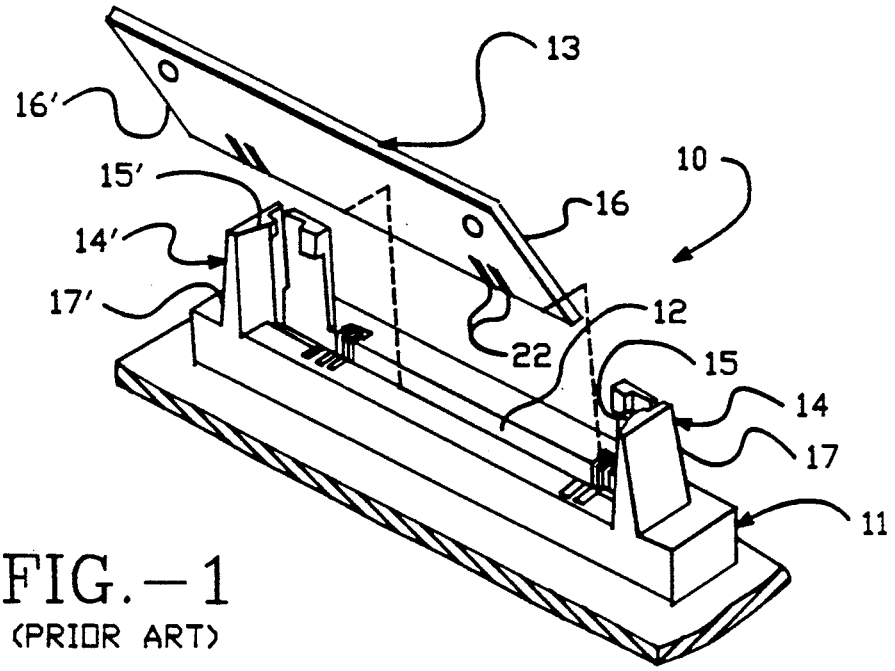
FIG.—1 (PRIOR ART)
FIG. 1 is a schematic, top perspective view of a prior art card-edge connector assembly including integrally molded latches.
Figure 2:
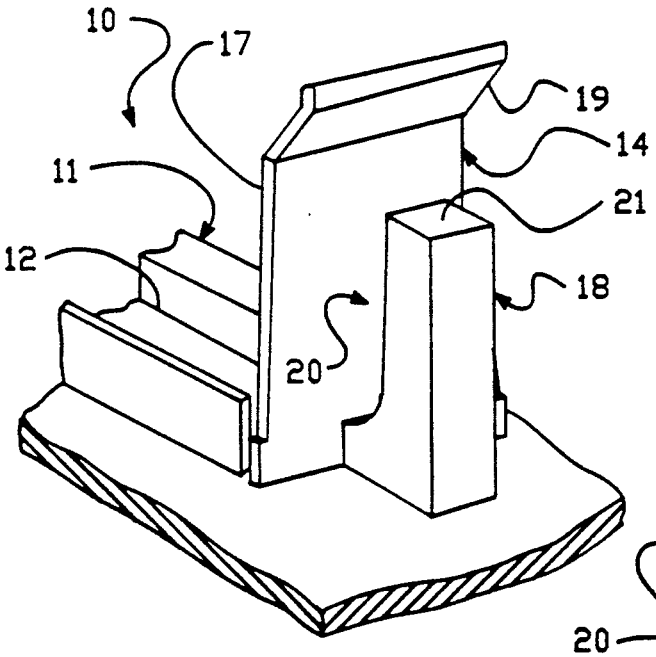
FIG.—2 (PRIOR ART)
FIG. 2 is an enlarged, fragmentary, top perspective view of a prior art card-edge connector having an integrally molded backstop and a latch with a cantilever portion.
Figure 3:
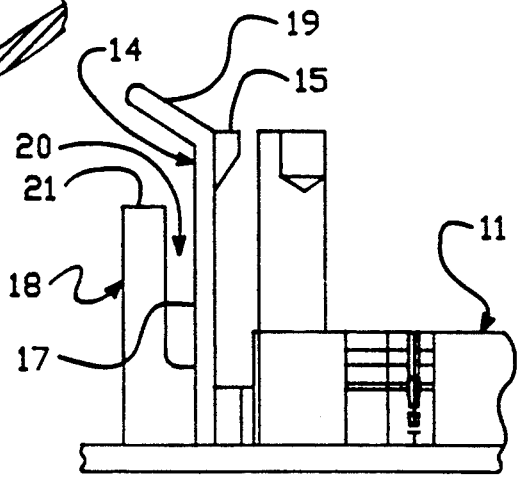
FIG.—3 (PRIOR ART)
FIG. 3 is a fragmentary side elevation view of the prior art card-edge connector of FIG. 2.

The card-edge electrical connector of the present invention simplifies manufacturing and production of these connectors by eliminating the use of slide core mold components during the injection molding process. While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

It will be noted here that for a better understanding, like components are designated by like reference numerals throughout the various figures.

Figure 4:
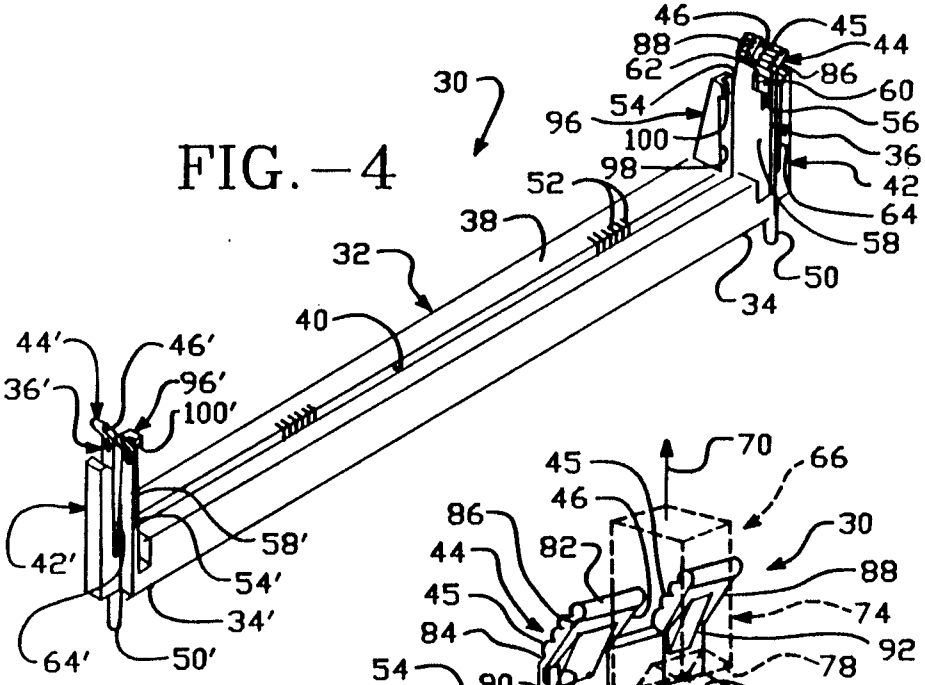
FIG. 4 is top perspective view of a card-edge connector designed in accordance with the present invention.

Attention is now directed to FIG. 4, where the subject card-edge connector, generally designated 30, is illustrated. Briefly, connector 30 includes an elongated electrically insulative housing 32 including a first housing end 34, an opposing second housing end 34' and a top side 38. An elongated board-edge receiving channel 40, provided in the top side 38, extends between first housing end 34 and second housing end 34', and is dimensioned to receive a board-edge of a secondary circuit board, such as circuit board 13 in FIG. 1. Situated at first and second opposing housing ends 34 and 34' of housing 32 and of elongated channel 40, are a pair of latch members 36 and 36' integrally formed with housing 32. Latch members 36 and 36' are dimensioned to engage a respective side edge, such as side edges 16 and 16', of a secondary circuit board, such as board 13 of FIG. 1. Latches 36, 36' releasably secure the circuit board in its operating position in channel 40 of card-edge connector 30. Additionally, first and second backstop portions 42 and 42' are positioned, respectively, behind first and second latch members 36 and 36' in a direction away from channel 40. Backstop portions 42 and 42', integrally formed with housing 32, extend outwardly from top side 38 of housing 32, as shown in FIG. 4–7, to positions below the corresponding latch levers 44 and 44', and outwardly of the latch members 36 and 36'.

In accordance with the present invention, it is desirable to manufacture a unitary card-edge connector 30, including: housing 32; latches 36 and 36' having corresponding latch levers 44 and 44'; and corresponding backstop portions 42 and 42' positioned below latch levers 44 and 44', in the most cost effective and efficient method possible. Thus, it is preferable to provide a connector having the above mentioned components which can be molded exclusively from meshing mold components, while eliminating the need for slide core mold components usage.

Figure 7:
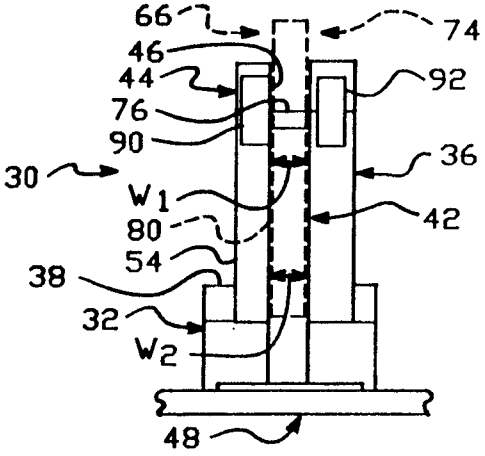
FIG. 7 is an enlarged, fragmentary, rear elevation view of one end of the card-edge connector assembly of FIG. 6.
Figure 5:
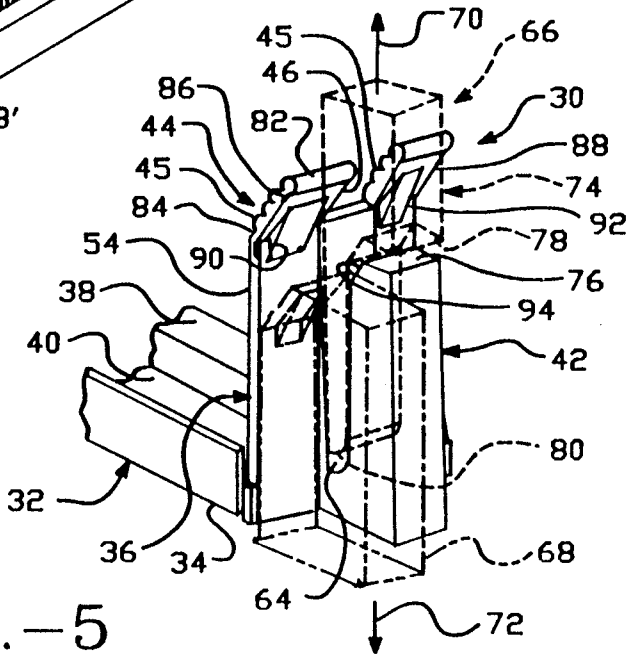
FIG. 5 is an enlarged, fragmentary, rear perspective view of one end of the card-edge connector assembly of FIG. 4 and illustrating portions of an upper and lower mold component.

Thus, as best viewed in FIGS. 4, 5 and 7, the present invention provides a card-edge connector 30 having mold component receiving openings 46 and 46' extending through portions of latch levers 44 and 44' which are sufficiently large to permit withdrawal of a mold component therethrough. As will be described in greater detail below, openings 46 and 46' are also sufficiently small to provide a substantial surface area remaining on latch levers 44 and 44' to enable manual release of latches 36 and 36'.

Referring back to FIG. 4, card-edge connector 30 will now be described in more detail. In the preferred form, card-edge connector 30 of the present invention is mounted to primary circuit board 48 (FIGS. 6 and 7) by housing mounting legs 50 and 50' extending downward from a bottom portion of housing 32. Legs 50 and 50' are integrally molded into housing 32 and are formed to extend through correspondingly dimensioned apertures (not shown) defined by primary circuit board 48 to allow mounting thereon. Connector 30 further includes a plurality of electrically conductive terminals 52 positioned inside channel 40 to engage respective conductive pads, such as pads 22 on board 13 in FIG. 1, which pads can be seen to be disposed on the board-edge device of the secondary circuit board.

As best shown in FIG. 4, first and second latch members 36 and 36' are integrally formed with housing 32 and are substantially resilient so that latch members 36 and 36' can be deflected rearward, respectively, in the direction away from receiving channel 40. Such deflection enables installation or removal of secondary circuit board.

Figure 6:
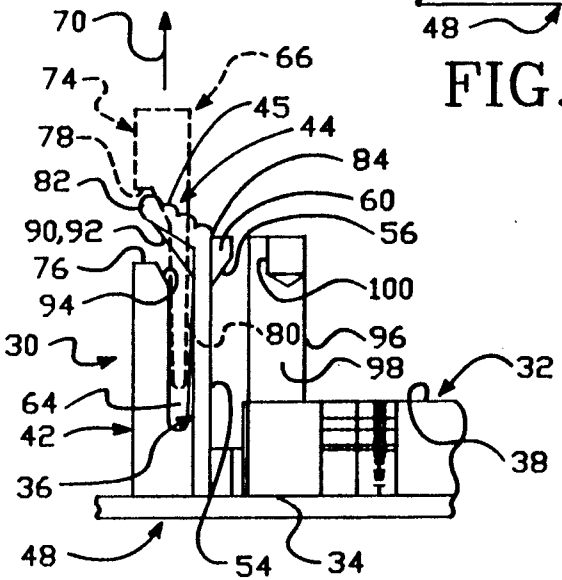
FIG. 6 is an enlarged, fragmentary, side elevation view of one end of the card-edge connector assembly of FIG. 4 and showing a slot-forming mold component of the upper mold component.

It will be understood that second latch 36' is symmetrical to, and a mirror-image of, first latch 36. Henceforth, only first latch 36 corresponding to first housing end 34 will be described in detail herein for brevity. Latch member 36 includes a main body portion 54 integrally formed with the top side 38 of housing 32. Body portion 54 is a relatively thin, rectangular-shaped member capable of resilient deflection in the direction toward the respective backstop 42. A detent member 56 projects from a forward facing substantially planar surface 58 which faces the rotating secondary circuit board. As shown in FIGS. 1 and 6, detent member 56 is, further, preferably positioned proximate an upper portion of body portion 54. Detent member 56 includes a camming wall 60, which is formed to engage the side edge, such as side edges 16 and 16', (not shown) of the secondary circuit board, such as board 13 of FIG. 1, upon rotational assembly. Wall 60 is inclined forwardly toward channel 40, as shown in FIG. 4. Additionally, detent member 56 includes a substantially planar retaining wall 62 which is formed to releasably retain the secondary circuit board in its operating position. Retaining wall 62 extends outward from, and is substantially perpendicular to, body portion 54.

Briefly, as the secondary circuit board is rotated in receiving channel 40 to its secured operating position, the board side edge engages camming wall 60 of detent member 56. During engagement, ramping forces deflect main body portion 54 rearward toward backstop 42 until the circuit board side edge clears retaining wall 62. After clearance, the resiliency of main body portion 54 urges main body portion 54 forward in a direction toward the receiving channel 40. Subsequently, planar retaining wall 62 engages a surface of the secondary circuit board, thereby retaining the secondary circuit board in an operating position.

As best viewed in FIG. 6, backstop 42 extends upwardly and outwardly from top side 38 and extends outwardly from body portion 54 so that a slot 64 is formed between backstop 42 and body portion 54. Thus, it will be understood that slot 64 is of a sufficient dimension to enable body portion 54 to be deflected rearward to effect release of the secondary circuit board before being limited upon engagement by backstop 42.

Latch member 36 includes latch lever portion 44, as shown in FIGS. 5 and 6, coupled to the upper portion of body portion 54. Latch lever 44, inclined upwardly and outwardly from body portion 54, facilitates manual release of detent member 56 by increasing access to latch member 36. Unfortunately, as mentioned, in this configuration, backstop 42 is positioned below portions of latch lever 44 so that backstop 42, slot 64 and portions of lever 44 vertically overlap with housing 32. Accordingly, the problem with the prior art connector assemblies is that the top side 38 of backstop 42 and slot 64 could not be molded through conventional meshing mold components without the use of an auxiliary slide core mold component.

In accordance with the present invention, card-edge connector 30 is to be fabricated exclusively through the use of meshing mold components. As best illustrated in FIG. 5, upper mold component 66 and lower mold component 68 cooperate to mold connector 30, including body portion 54, latch lever 44, backstop 42 and slot 64 without the use of a slide core mold component. Preferably, upper and lower mold components 66 and 68, respectively, are vertically meshing molds which are to be separated in oppositely opposing directions 180° apart, as illustrated by arrows 70 and 72 in FIG. 5.

The latch lever 44 of the present invention provides an opening 46 extending therethrough which is aligned substantially vertically above corresponding backstop 42 and slot 64 to enable integral molding of slot 64 and the top surface 76 of backstop 42 with housing 32. This is accomplished by withdrawal of a slot-forming post member 74 through opening 46, which is dimensioned to form slot 64 and backstop top surface 76, along the same direction (arrow 70) that upper mold component 66 separates from lower mold component 68. As viewed in FIG. 5, post member 74 includes a downwardly facing base surface 78 dimensioned to form backstop top surface 76, and a downwardly protruding finger member 80 dimensioned to form slot 64.

Thus, FIGS. 4 and 5 illustrate that opening 46 must be sufficiently large to allow withdrawal of slot-forming post member 74 of upper mold component 66. However, opening 46 must be sufficiently small so that the remaining upwardly facing engagable surface area of latch member 36 is substantial enough to enable manual operation of latch lever 44.. If the remaining surface area is too small, (i.e., if opening 46 is too large), access to latch lever 44 may be too difficult. Briefly, by applying a downward force, generally in the direction of arrow 72 in FIG. 5, on latch lever 44, main body portion 54 is deflected rearward toward backstop 42. This retracts and disengages detent member 56 from engaging the surface of the secondary circuit board, permitting the secondary circuit board, such as circuit board 13 in FIG. 1, to be removed from card-edge connector 30. Accordingly, the remaining surface area of latch lever 44 must be sufficient to effect release and to reduce potential damage to latch lever 44.

In the preferred form, opening 46, as best viewed in FIGS. 4 and 5, is rectangular-shaped and extends laterally from one end 82 of latch lever 44 to opposite end portion 84 where latch lever 44 is coupled to the upper end of main body portion 54. Opening 46 divides latch lever 44 into two separate cantilever sides 86 and 88. It is preferable, however, to manually engage both cantilever sides 86 and 88 simultaneously so that the releasing force applied thereto to deflect body portion 54 rearward will be evenly distributed throughout latch lever 44. Without distributing the release force, either cantilever side 86 or 88 may be over-stressed. Thus, opening 46 must not space cantilever sides 86 and 88 too far apart so that sides 86 and 88 cannot be simultaneously engaged.

Moreover, support webs 90 and 92 (FIG. 5) are preferably positioned behind cantilever sides 86 and 88, and body portion 54 for additional support.

Although, preferably, opening 46 extends laterally from one end 82 of latch lever 44 to opposite end 84, it will be appreciated that opening 46 could extend from a side edge of latch lever 44 and terminate at an intermediate portion thereof. Moreover, opening 46 could further include an aperture extending through latch lever 44 without departing from the true spirit and nature of the present invention.

Preferably, gripping ribs 45 extend transversely across cantilever sides 86 and 88 of latch lever 44, as shown in FIGS. 4 and 6. Ribs 45 facilitate gripping of latch levers 44 and 44' during manual engagement.

To effect withdrawal of post member 74, the cross-sectional width, $W_1$ in FIG. 7, of an upper portion of post member 74 is preferably slightly larger than the cross-sectional width, $W_2$ in FIG. 7, of a lower portion of post member 74. Accordingly, the cross-sectional width of post member 74 tapers inwardly from the upper portion to the lower portion of post member 74. This facilitates unobstructed withdrawal of post member 74 from opening 46.

As best shown in FIG. 5, lower mold component 68 meshes with slot-forming post member 74 of upper mold component 66 to integrally mold latch member 36, slot 64 and backstop 42. Thus, similar to the inward taper of the cross-sectional width of post member 74, backstop 42 also tapers inwardly from an upper backstop portion to a lower backstop portion. This configuration facilitates removal of lower mold component 68 from backstop 42 in the direction of arrow 72.

In the preferred embodiment, top surface 76 of backstop 42 includes a latch engaging surface 94 inclined downwardly toward latch member 36. Engaging surface 94 is oriented such that surface 94 fits the motion orbit of the main body portion 56 when the same is urged rearward. Accordingly, engaging surface 94 prevents body portion 54 from being over-deflected in the rearward direction.

Extending upward from the top side 38 of housing 32 is a circuit board support 96 which includes a substantially vertical wall 98 disposed adjacent board-edge receiving channel 40. As viewed in FIG. 1, board support 96 is positioned proximate first housing end 34 but remains positioned between latch members 36 and 36'. Board support 96 is substantially rigid and inflexible in response to the forces exerted against vertical wall 98 during the secondary circuit board's rotation to its operating position. Thus, vertical wall 98 acts as a seat against which the rear face (not shown) of the secondary circuit board rests against while retained in its operating position.

Additionally, protruding perpendicularly outward from respective vertical wall 98, in a direction perpendicular to the vertical channel plane, is an alignment post 100, which is aligned for engaging a correspondingly dimensioned aperture (not shown) through the secondary circuit board. When the respective alignment post 100 is inserted into the respective aperture, alignment post 100 causes the secondary circuit board to be both accurately positioned relative to the terminals 52 and to prevent improper or unintended withdrawal from card-edge connector 30.

A second board support 96' substantially symmetrical to first board support 96, is positioned proximate second housing end 34' of housing 32. As can be seen, this mirror-image structure is disposed on the opposite end of the elongated receiving channel 40 and includes an identical structure which performs the identical functions as first board support 96.

What is claimed is:

1. A card-edge connector assembly for releasably securing a circuit board having a front edge and opposite side edges, said connector assembly comprising:

an elongated electrically insulative housing formed of a moldable material and defining an elongated channel in a surface of said housing and formed to receive the front edge of the circuit board;

a first latch member and a second latch member positioned proximate opposite ends of said channel and integrally formed with said housing;

said first latch member and said second latch member each including, a body portion extending outwardly from said surface, detent means extending outwardly from an upper end of said body portion for engaging said respective side edges of said circuit board, and a latch lever inclined angularly upwardly and outwardly from said upper end of said body portion;

a first backstop member and a second backstop member disposed proximate said first latch member and said second latch member, respectively, each backstop member being integrally formed with said housing and extending outwardly from said surface of said housing to positions substantially vertically below said latch lever and outwardly of said first latch member and said second latch member;

said first backstop member and said second backstop member defining with said first latch member and said second latch member slots permitting limited deflection of said first latch member and said second latch member in a direction toward said first backstop member and said second backstop member, respectively; and said latch lever of each of said first latch member and said second latch member defining a central mold opening extending therethrough and positioned in vertical alignment with each of said first backstop member and said second backstop member, each said mold opening being sufficiently large to permit withdrawal of a slot defining-mold component along a substantially linear path away from said slots extending through said mold opening during integral molding of said latch members and said backstop members with said housing, and said opening being sufficiently small to provide substantial area on said latch lever portion to enable manual release of said latch members.

2. The card-edge connector as defined in claim 1 wherein, each said backstop member includes opposite side walls tapering inwardly from an upper portion of said backstop member to a lower portion of said backstop member.

3. The card-edge connector as defined in claim 1 wherein, said slot defining-mold component further defines a backstop top surface of each said backstop members.

4. The card-edge connector as defined in claim 1 wherein, each said backstop top surface includes a latch engaging surface inclined downwardly toward respective latch members.

5. The card-edge connector as defined in claim 4 further including:

a board support member upstanding from an edge of said slot and having an arm portion extending forward in the direction of said slot, said arm portion cooperative with a respective opening in the circuit board for supporting the board when releasably secured in said slot.

6. The card-edge connector as defined in claim 1 wherein, each said latch lever includes traversally extending-ribs positioned on an upper surface of said latch lever.

7. The card-edge connector as defined in claim 1 wherein, said opening is substantially rectangular shaped and extends from an upper distal end to a base portion of latch lever.

8. In a card-edge connector assembly for releasably securing a circuit board having a front edge thereto, said assembly including an elongated electrically insulative housing formed of a moldable material and defining an elongated front edge receiving channel in a surface of said housing, a latch member positioned proximate one end of said channel and integrally formed with said housing, said latch member including, a body portion extending outwardly from said surface, detent means extending outwardly from an upper end of said body portion for engaging a side edge of said circuit board, and a latch lever inclined angularly upwardly and outwardly from said upper end of said body portion, said connector assembly further including a backstop member disposed proximate said latch member and integrally formed with said housing and extending outwardly from said surface of said housing to a position below said latch lever and outwardly of said latch member, said backstop member defining with said latch member a slot permitting limited deflection of said latch member toward said backstop member, the improvement comprising:

said latch lever defining a central mold opening extending therethrough and positioned in vertical alignment with said backstop member, said mold opening being sufficiently large to permit withdrawal of a slot defining-mold component along a substantially linear path away from said slot extending through said mold opening during integral molding of said latch member and said backstop member with said housing, and said opening being sufficiently small to provide substantial area on said latch lever portion to enable manual release to said latch members.

* * * * *